US009707619B2

(12) United States Patent
Iwamoto et al.

(10) Patent No.: US 9,707,619 B2
(45) Date of Patent: Jul. 18, 2017

(54) SQUEEZE PIN CIRCUIT FOR DIE CASTING AND HYDRAULIC UNIT

(71) Applicant: KEIHIN CORPORATION, Tokyo (JP)

(72) Inventors: Norihiro Iwamoto, Sagamihara (JP); Fumihiro Sakuma, Kakuda (JP); Tetsuya Uehara, Kakuda (JP)

(73) Assignee: KEIHIN CORPORATION, Tokyo (JP)

( * ) Notice: Subject to any disclaimer, the term of this patent is extended or adjusted under 35 U.S.C. 154(b) by 0 days.

(21) Appl. No.: 15/301,079

(22) PCT Filed: Mar. 30, 2015

(86) PCT No.: PCT/JP2015/059853
§ 371 (c)(1),
(2) Date: Sep. 30, 2016

(87) PCT Pub. No.: WO2015/163088
PCT Pub. Date: Oct. 29, 2015

(65) Prior Publication Data

US 2017/0014900 A1 Jan. 19, 2017

(30) Foreign Application Priority Data

Apr. 25, 2014 (JP) ..... 2014-091854
Jul. 22, 2014 (JP) ..... 2014-149056

(51) Int. Cl.
*B22D 17/32* (2006.01)
*B22D 17/20* (2006.01)

(52) U.S. Cl.
CPC ..... *B22D 17/32* (2013.01); *B22D 17/203* (2013.01)

(58) Field of Classification Search
CPC .. B22D 17/2015; B22D 17/203; B22D 17/24; B22D 17/32
(Continued)

(56) References Cited

U.S. PATENT DOCUMENTS 5,555,924 A * 9/1996 Iwamoto ..... B22D 27/11 164/120
6,581,379 B2 * 6/2003 Nomura ..... B22D 17/203 60/563
(Continued)

FOREIGN PATENT DOCUMENTS

JP 58221654 A * 12/1983 ..... B22D 17/32
JP H09-225619 A 9/1997
(Continued)

OTHER PUBLICATIONS

Apr. 28, 2015 International Search Report issued in International Patent Application No. PCT/JP2015/059853.
(Continued)

*Primary Examiner* — Kevin E Yoon
(74) *Attorney, Agent, or Firm* — Oliff PLC

(57) ABSTRACT

A squeeze pin circuit is installed to a direction switching valve. The direction switching valve is configured to switch a direction of hydraulic pressure to a core cylinder. The squeeze pin circuit is configured to drive a squeeze pin. The squeeze pin is configured to partially pressurize molten metal filled in a cavity. The squeeze pin circuit includes a squeeze pin cylinder and a flow rate adjusting unit. The squeeze pin cylinder is coupled to the direction switching valve to drive the squeeze pin. The flow rate adjusting unit is installed on a hydraulic pressure path. The hydraulic pressure path couples the direction switching valve to a head side of the squeeze pin cylinder. The flow rate adjusting unit is configured to ensure pressure compensation and temperature compensation.

11 Claims, 11 Drawing Sheets

(58) Field of Classification Search
USPC ..... 164/4.1, 113, 120, 155.3, 157, 303, 312
See application file for complete search history.

(56) References Cited

U.S. PATENT DOCUMENTS

| | | | | |
|---|---|---|---|---|
| 6,629,558 | B2 * | 10/2003 | Tsuji | B22D 17/32 164/154.1 |
| 6,871,688 | B2 * | 3/2005 | Yamazaki | B22D 17/32 164/132 |

FOREIGN PATENT DOCUMENTS

| | | | |
|---|---|---|---|
| JP | 2001-246658 | A | 9/2001 |
| JP | 2011-050974 | A | 3/2011 |
| JP | 2011-115811 | A | 6/2011 |

OTHER PUBLICATIONS

Apr. 28, 2015 Written Opinion issued in International Patent Application No. PCT/JP2015/059853.

* cited by examiner

SQUEEZE PIN CIRCUIT FOR DIE CASTING AND HYDRAULIC UNIT

TECHNICAL FIELD

The present invention relates to a squeeze pin circuit to drive a squeeze pin that partially pressurizes molten metal filled in a mold cavity and a hydraulic unit that contains the squeeze pin circuit.

BACKGROUND ART

A high-pressure die casting is performed by injecting molten metal in a mold cavity at high speed to fill the cavity. A temperature during the filling is around 650° C., and an extraction temperature when the molten metal is subsequently rapidly cooled and around 10 seconds elapses after the cooling becomes 250° C. This rapid cooling solidifies and shrinks the molten metal, thus generating a shrinkage cavity inside a die-cast product. Since a volume of the shrinkage cavity increases as a thickness of the die-cast product thickens, this causes a failure affecting an internal quality of the die-cast product.

To eliminate this failure, a squeeze pin is pushed into molten metal immediately before the molten metal inside a cavity solidifies to locally pressurize the molten metal, thus preventing a shrinkage cavity (see Patent Document 1). At this time, the squeeze pin is operated by operating a squeeze pin cylinder to which the squeeze pin is installed by hydraulic pressure.

Meanwhile, a mold internally includes a core to form an outer shape part of a die-cast product that cannot be formed with the mold. After the molten metal is solidified, a core circuit to apply a hydraulic pressure to the core extracts the core from the mold. A usual high-pressure die casting apparatus preliminary includes this core circuit (see Patent Document 2).

Therefore, to prevent the shrinkage cavity in the die-cast product requiring the core, not only the core circuit, which operates the core, but also a hydraulic system to operate the squeeze pin is necessary. This causes problems of large high-pressure die casting apparatus and a cost increase. Accordingly, for simplification and cost reduction of the high-pressure die casting apparatus, using the core circuit also for operating the squeeze pin is considered.

Patent Document 1: Japanese Unexamined Patent Application Publication No. 9-225619

Patent Document 2: Japanese Unexamined Patent Application Publication No. 2001-246658

DISCLOSURE OF THE INVENTION

Problem to be Solved by the Invention

However, the double use of the core circuit as described above causes the following problems. (1) The core circuit equipped with the high-pressure die casting apparatus includes a hydraulic control circuit with large flow rate to move the core fast for cycle-up. However, with this hydraulic control circuit, an adjustment of a low flow rate to slowly move the core like the squeeze pin as the formation of the shrinkage cavity is difficult. (2) Since the squeeze pin is operated from when the molten metal is half solidified until immediately before the molten metal is solidified, a variation of load is large. This makes it difficult to maintain an amount of driving of the squeeze pin driven at the low flow rate as designed. (3) Viscosity of operating oil for the high-pressure die casting apparatus changes as a temperature of the operating oil changes. This changes a speed of a squeeze pin cylinder, making the operation of the squeeze pin following the formation of the shrinkage cavity difficult. The present invention has focused on the problems, and an object of the present invention is to provide a squeeze pin circuit for die casting that ensures excellent operation of the squeeze pin even the use of the existing core circuit and a hydraulic unit that contains the squeeze pin circuit.

Solutions to the Problems

To solve at least some of the above-described problems, a first squeeze pin circuit for die casting according to the present invention is installed to a direction switching valve. The direction switching valve is configured to switch a direction of hydraulic pressure to a core cylinder. The squeeze pin circuit is configured to drive a squeeze pin. The squeeze pin is configured to partially pressurize molten metal filled in a cavity. The squeeze pin circuit includes a squeeze pin cylinder and a flow rate adjusting unit. The squeeze pin cylinder is coupled to the direction switching valve to drive the squeeze pin. The flow rate adjusting unit is installed on a hydraulic pressure path. The hydraulic pressure path couples the direction switching valve to a head side of the squeeze pin cylinder. The flow rate adjusting unit is configured to ensure pressure compensation and temperature compensation.

The above-described configuration includes the flow rate adjusting unit, which ensures the pressure compensation and the temperature compensation, between the direction switching valve and the squeeze pin cylinder. This ensures applying the pressure to the squeeze pin so as to be a constant speed with the low operating speed of the squeeze pin regardless of the change in the pressure (the drag) that the squeeze pin receives from the molten metal and the temperature change in the operating oil. Accordingly, this allows the existing core circuit to reliably perform the operation of the squeeze pin, which locally applies the pressure to the molten metal in association with the formation of the shrinkage cavity.

In a second squeeze pin circuit, the flow rate adjusting unit includes a check valve. The check valve is configured to allow a hydraulic pressure in a direction heading for the direction switching valve in the hydraulic pressure path. This configuration allows the squeeze pin to return to an original position at a speed faster than the speed of entering the squeeze pin to the molten metal.

In a third squeeze pin circuit, the flow rate adjusting unit is configured to ensure displaying a degree of opening in the hydraulic pressure path in digital. This configuration enhances reproducibility of the degree of opening in the flow rate adjusting unit, thereby ensuring improvising work efficiency.

In a fourth squeeze pin circuit, the hydraulic pressure path is coupled parallel to a hydraulic pressure path at one side of the core cylinder. A hydraulic pressure path coupling the direction switching valve to a rod side of the squeeze pin cylinder is coupled parallel to a hydraulic pressure path at another side of the core cylinder. The configuration can omit replacement work to the direction switching valve between the core cylinder and the squeeze pin cylinder, ensuring reduction in work load.

In a fifth squeeze pin circuit, the plurality of squeeze pin cylinders and the plurality of flow rate adjusting units are coupled parallel to the direction switching valve. The configuration ensures concurrent operation of the plurality of the squeeze pins.

A sixth squeeze pin circuit further includes an accumulator circuit configured to accumulate a hydraulic pressure from a hydraulic pressure source that supplies the direction switching valve with a hydraulic pressure. The accumulator circuit is configured to supply the hydraulic pressure to hydraulic pressure paths on primary sides of the flow rate adjusting units. Even if a large number of the flow rate adjusting units are coupled in parallel, the configuration reliably supplies the hydraulic pressure to the respective flow rate adjusting units, thereby ensuring reliably operating the squeeze pins.

A hydraulic unit according to the present invention includes the above-described squeeze pin circuit for die casting. The hydraulic unit includes a block to which the flow rate adjusting unit is installed. The block includes a hydraulic pressure path at the primary side of the flow rate adjusting unit. The block includes a bus line. The bus line is coupled to the hydraulic pressure path on the primary side. The bus line penetrates the block.

With the configuration, the use of the plurality of hydraulic units ensures operating the large number of squeeze pins. Only coupling the bus lines completes the coupling between the squeeze pin circuits. This allows quick handling of a change such as an addition of the squeeze pin. In this case, it is only necessary to couple the accumulator circuit to any one of the bus lines for the hydraulic units.

A second hydraulic unit further includes a limit switch and time measurement means. The limit switch is configured to output a signal indicative of the squeeze pin being at a position before feeding. The limit switch is configured to output a signal indicative of the squeeze pin being at a position after the feeding. The time measurement means is installed to the block. The time measurement means is configured to measure an operating time of the squeeze pin based on the signal output from the limit switch. This configuration ensures measuring a time from a start of feeding of the squeeze pin until the end of the feeding. Thus, a quality management of die-cast products requiring the operation of the squeeze pin can be easily performed.

With a third hydraulic unit, pressure measurement means is installed to the block. The pressure measurement means is configured to measure a hydraulic pressure inside the bus line. The feature allows measuring the hydraulic pressure inside the bus line during the operation of the squeeze pin. Additionally, whether the pressure value is sufficient to the primary sides of the flow rate adjusting units or not can be determined.

With a fourth hydraulic unit, the block is installed to a mold to which the squeeze pin is installed. The squeeze pin is driven by the squeeze pin circuit. With the mold, the identical die casting forming is repeated; therefore, the squeeze pin installed to the mold also repeats the identical operation at the die casting forming. Accordingly, with the configuration, once setting the degrees of opening by the flow rate adjusting units, the subsequent change is unnecessary. Accordingly, installing the blocks individually to various kinds of molds allows the efficient die casting forming omitting the adjustment work of the operation of squeeze pins when the type of the mold is changed.

With a fifth hydraulic unit, in a case where the plurality of flow rate adjusting units are installed to the block, the block is installed to the mold in a vertically-elongated state. The flow rate adjusting units are installed to the block to be arranged in the vertically-elongated direction. With the configuration, configuring the vertical block ensures establishing the space-saving hydraulic units (the squeeze pin circuits).

Effects of the Invention

The squeeze pin circuit for die casting according to the present invention includes the flow rate adjusting unit, which ensures the pressure compensation and the temperature compensation, between the direction switching valve and the squeeze pin cylinder. This ensures applying the pressure to the squeeze pin so as to be a constant speed with the low operating speed of the squeeze pin regardless of the change in the pressure (the drag) that the squeeze pin receives from the molten metal and the temperature change in the operating oil. Accordingly, this allows the existing core circuit to reliably perform the operation of the squeeze pin, which locally applies the pressure to the molten metal in association with the formation of the shrinkage cavity. With the hydraulic unit according to the present invention, the use of the plurality of hydraulic units ensures operating the large number of squeeze pins. Only coupling the bus lines completes the coupling between the squeeze pin circuits. This allows quick handling of a change such as an addition of the squeeze pin.

DESCRIPTION OF PREFERRED EMBODIMENTS

Hereinafter, embodiments of the present invention will be described in detail with reference to the drawings. The constituent elements, kinds, combinations, shapes, relative positions thereof, and the like described in the embodiments are not construed as limiting to the scope of the invention, but are just simply described examples.

Figure 2:
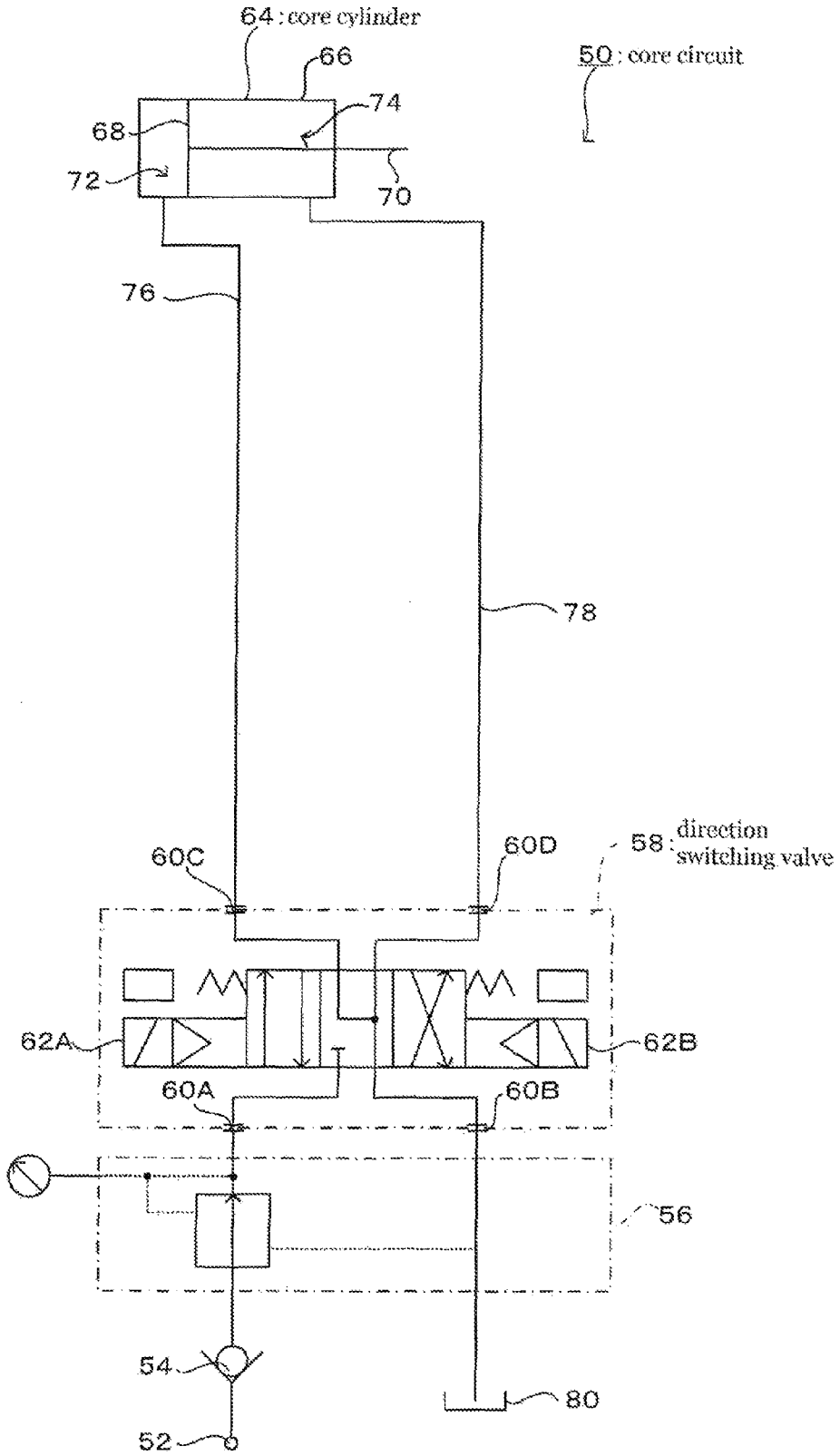
FIG. 2 is a circuit diagram illustrating a core circuit, an application target for the squeeze pin circuit of the first embodiment.

FIG. 2 illustrates a core circuit, an application target for a squeeze pin circuit of an embodiment. As illustrated in FIG. 2, a core circuit 50 is attached to a high-pressure die casting apparatus (not illustrated) and includes a hydraulic pressure supply source 52, a check valve 54, a pressure adjusting valve 56, a direction switching valve 58, and a core cylinder 64. Although the illustration is omitted, the hydraulic pressure supply source 52 is configured of a hydraulic pressure pump, a motor rotating the hydraulic pressure pump, a tank (a tank 80) accumulating operating oil, a filter, an accumulator, and a similar member. The filter is installed to a distal end of a taking-in hose for hydraulic pressure pump that takes in the operating oil from the tank. The accumulator further increases the hydraulic pressure supplied from the hydraulic pressure pump. A relief valve (not illustrated) that determines an upper limit of the hydraulic pressure in a hydraulic pressure path is also installed. The check valve 54 inhibits the hydraulic pressure heading for the hydraulic pressure supply source 52 side. The pressure adjusting valve 56 adjusts the hydraulic pressure supplied to the direction switching valve 58.

The direction switching valve 58 switches a direction of the hydraulic pressure to the core cylinder 64. The direction switching valve 58 includes a port 60A, a port 60B, a port 60C, and a port 60D. The port 60A is coupled to the hydraulic pressure supply source 52 side while the port 60B is coupled to the tank 80.

In a neutral state, the direction switching valve 58 couples the port 60C to the port 60D parallel to the port 60B. Meanwhile, driving a solenoid 62A couples the port 60A to the port 60C and couples the port 60B to the port 60D. Driving a solenoid 62B couples the port 60A to the port 60D and couples the port 60B to the port 60C.

The core cylinder 64 includes a cylinder body 66 and a rod 70. The rod 70 is housed in the cylinder body 66 and is directly coupled to a core (not illustrated). A head 68 is disposed at a distal end of the rod 70. The head 68 partitions an inside of the cylinder body 66 into a hydraulic pressure space 72 on the head 68 side and a hydraulic pressure space 74 on the rod 70 side. The hydraulic pressure space 72 on the head 68 side is coupled to the port 60C of the direction switching valve 58 through a hydraulic pressure path 76. The hydraulic pressure space 74 on the rod 70 side is coupled to the port 60D of the direction switching valve 58 through a hydraulic pressure path 78.

Driving the solenoid 62A supplies the head 68 side with the hydraulic pressure and pushes the head 68 to the rod 70 side. Thus, the rod 70 pushes the core (not illustrated) into a mold (a cavity) side. At this time, the operating oil filled in the hydraulic pressure space 74 on the rod 70 side is pressed from the cylinder body 66 and is returned to the tank 80 via the hydraulic pressure path 78 and the direction switching valve 58.

Contrary, driving the solenoid 62B supplies the rod 70 side with the hydraulic pressure and pulls the rod 70 to the head 68 side. Thus, the core (not illustrated) is extracted from the mold (solidified molten metal). At this time, the operating oil filled in the hydraulic pressure space 72 on the head 68 side is pressed from the cylinder body 66 and is returned to the tank 80 via the hydraulic pressure path 76 and the direction switching valve 58.

Furthermore, when the direction switching valve 58 enters the neutral state, the hydraulic pressure path 76 and the hydraulic pressure path 78 join together at the direction switching valve 58 and are coupled to the tank 80. Accordingly, the operating oil introduced to the hydraulic pressure space 72 or the hydraulic pressure space 74 of the core cylinder 64 (one to which the hydraulic pressure has been applied last) is released from the hydraulic pressure and is returned to the tank 80.

Figure 1:
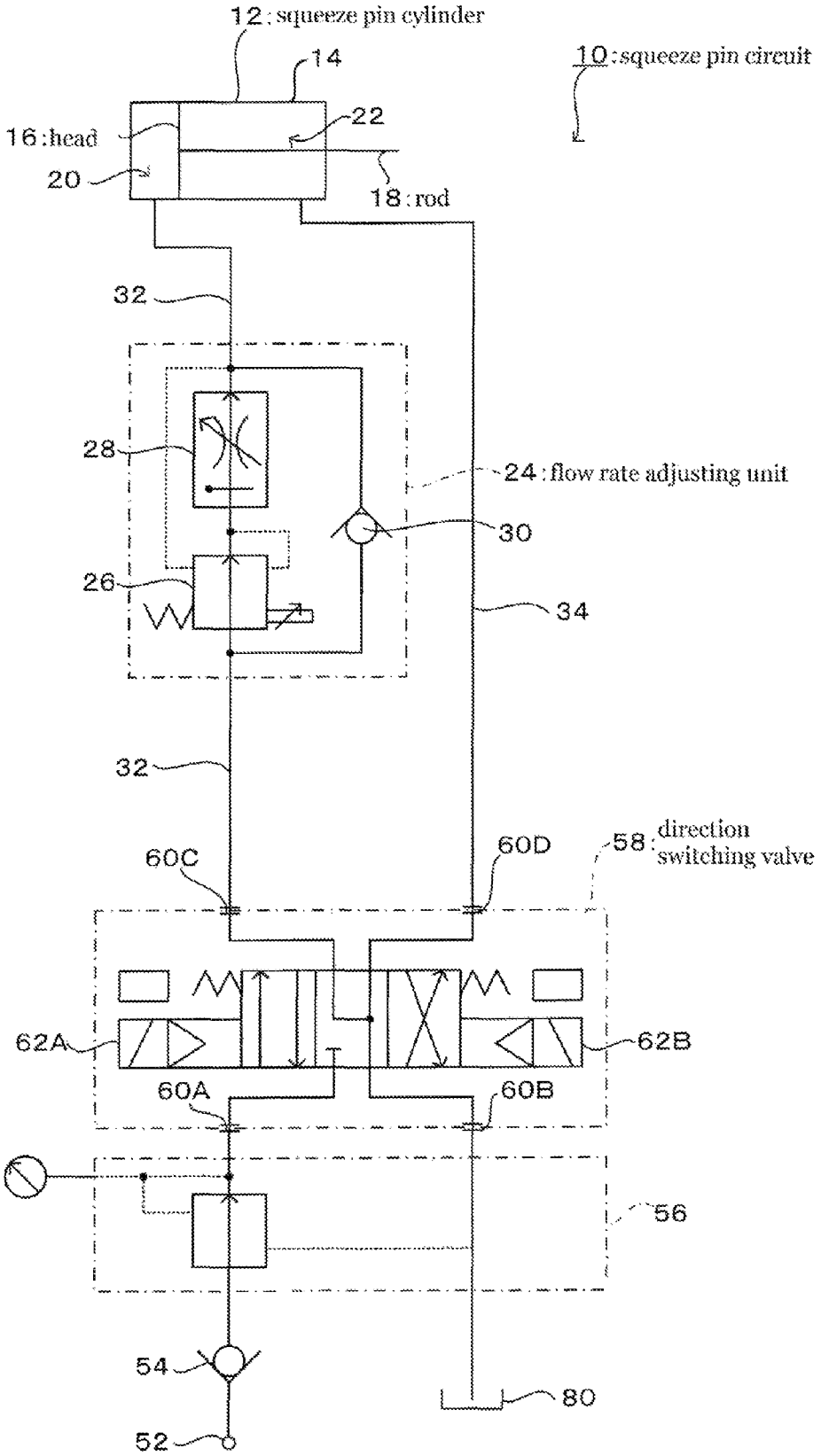
FIG. 1 is a circuit diagram of a squeeze pin circuit of a first embodiment.

FIG. 1 illustrates the squeeze pin circuit of a first embodiment. A squeeze pin circuit 10 of the first embodiment is configured by removing the core cylinder 64 in the core circuit 50 and the squeeze pin cylinder 12 and a flow rate adjusting unit 24 are installed to the direction switching valve 58.

The squeeze pin circuit 10 of this embodiment is the squeeze pin circuit 10 installed to the direction switching valve 58, which switches the direction of hydraulic pressure to the core cylinder 64, to drive a squeeze pin (not illustrated), which partially pressurizes the molten metal filled in a mold cavity. The squeeze pin circuit 10 has a feature of including a squeeze pin cylinder 12 and a flow rate adjusting unit 24. The squeeze pin cylinder 12 is coupled to the direction switching valve 58 to drive the squeeze pin. The flow rate adjusting unit 24 is installed on a hydraulic pressure path 32, which couples the direction switching valve 58 to the head 16 side of the squeeze pin cylinder 12, and is configured to perform a pressure compensation and a temperature compensation.

The squeeze pin cylinder 12 is configured of a cylinder body 14 and a rod 18 housed in the cylinder body 14. The head 16 is installed to one end part of the rod 18, and the other end part of the rod 18 is directly coupled to the squeeze pin (not illustrated). The head 16 separates an inside of the cylinder body 14 into a hydraulic pressure space 20 on the head 16 side and a hydraulic pressure space 22 on the rod 18 side. The hydraulic pressure space 20 on the head 16 side is coupled to the port 60C of the direction switching valve 58 with the hydraulic pressure path 32. The hydraulic pressure space 22 on the rod 18 side is coupled to the port 60D of the direction switching valve 58 with a hydraulic pressure path 34. The flow rate adjusting unit 24 is interposed at the hydraulic pressure path 32.

The flow rate adjusting unit 24 adjusts the hydraulic pressure supplied to the hydraulic pressure space 20 on the head 16 side to a pressure corresponding to an operating speed required for the squeeze pin. The flow rate adjusting unit 24 includes a pressure compensation valve 26, a flow rate adjusting valve 28 (including a temperature compensation orifice), and a check valve 30. The pressure compensation valve 26 and the flow rate adjusting valve 28 are coupled in series at the hydraulic pressure path 32 such that the pressure compensation valve 26 is disposed on the direction switching valve 58 side and the flow rate adjusting valve 28 is disposed on the squeeze pin cylinder 12 side. The check valve 30 is coupled parallel to a hydraulic pressure path where the pressure compensation valve 26 and the flow rate adjusting valve 28 are disposed in series.

The pressure compensation valve 26 adjusts a degree of opening of an orifice of itself at the hydraulic pressure path 32 corresponding to a change in differential pressure between the hydraulic pressure between the pressure compensation valve 26 and the flow rate adjusting valve 28 and the hydraulic pressure between the flow rate adjusting valve 28 and the squeeze pin cylinder 12 for adjustment to be a constant differential pressure. The flow rate adjusting valve 28 is a part that adjusts a degree of opening of the orifice of itself at the hydraulic pressure path 32 to adjust the hydraulic pressure supplied to the hydraulic pressure space 20 on the head 16 side. The flow rate adjusting valve 28 has a thin-bladed orifice by which an influence from a flow rate coefficient becomes small. Accordingly, the flow rate adjusting valve 28 serves as the temperature compensation orifice that causes the operating oil with constant flow rate to flow through independent of temperature change and without being affected by a change in viscosity in association with the temperature change of the operating oil. The check valve 30 inhibits the hydraulic pressure heading from the direction switching valve 58 to the squeeze pin cylinder 12 to block the operating oil to flow through and allows the hydraulic pressure heading for the opposite direction to cause the operating oil to flow through.

In this embodiment, driving the solenoid 62A causes the check valve 54 to block the flowing of the operating oil. Meanwhile, the flow rate adjusting unit 24 supplies the hydraulic pressure with the above-described constant differential pressure to the hydraulic pressure space 20 on the head 16 side. Accordingly, while the squeeze pin maintains the constant differential pressure (a difference between the pressure of the squeeze pin to the molten metal and a drag of the molten metal to the squeeze pin) with respect to the molten metal, the squeeze pin enters the inside of the molten metal at a slow speed. At this time, the operating oil filled in the hydraulic pressure space 22 on the rod 18 side is pressed from the cylinder body 14 and is returned to the tank 80 via the hydraulic pressure path 34 and the direction switching valve 58.

Driving the solenoid 62B supplies the hydraulic pressure space 22 on the rod 18 side with the hydraulic pressure. At this time, the check valve 30 allows the hydraulic pressure heading for the direction switching valve 58 side. This presses the operating oil filled in the hydraulic pressure space 20 on the head 16 side from the cylinder body 14 and returns the operating oil to the tank 80 via the check valve 54 and the direction switching valve 58. At this time, the squeeze pin is pulled out from the molten metal after being solidified. Since the degree of opening of the check valve 54 is designed larger than the degrees of opening of the pressure compensation valve 26 and the flow rate adjusting valve 28, the speed becomes faster than the speed when the squeeze pin enters the molten metal.

The squeeze pin circuit 10 according to the first embodiment includes the flow rate adjusting unit 24, which ensures the pressure compensation and the temperature compensation, between the direction switching valve 58 and the squeeze pin cylinder 12. This ensures applying the pressure to the squeeze pin so as to be a constant speed with the low operating speed of the squeeze pin regardless of the change in the pressure (the drag) that the squeeze pin receives from the molten metal and the temperature change in the operating oil. Accordingly, this allows the existing core circuit 50 to reliably perform the operation of the squeeze pin, which locally applies the pressure to the molten metal in association with the formation of the shrinkage cavity. Since the squeeze pin circuit 10 includes the check valve 54, this allows the squeeze pin to return to an original position at a speed faster than the speed of entering the squeeze pin to the molten metal.

Figure 3:
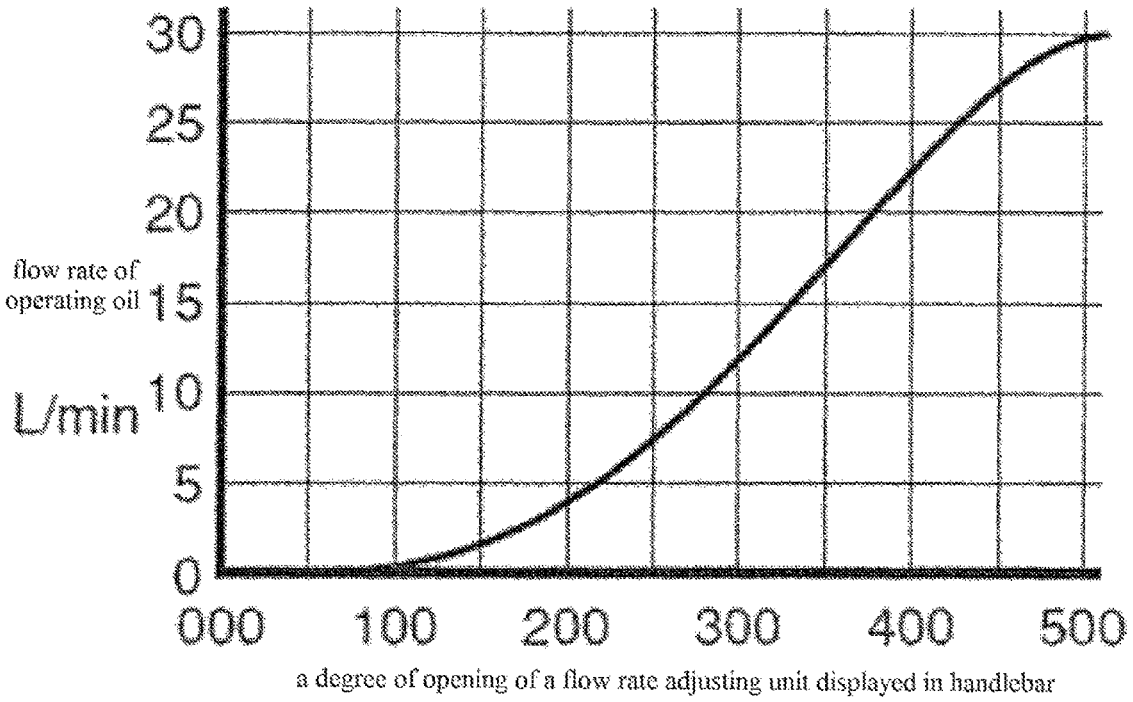
FIG. 3 is a drawing showing a relationship between a degree of opening of a flow rate adjusting unit and a flow rate of operating oil.

FIG. 3 shows a relationship between the degree of opening of the flow rate adjusting unit and the flow rate of the operating oil. The inventors of the present application examined the relationship between the operation of the squeeze pin and the flow rate of the operating oil by the flow rate adjusting unit 24 according to the embodiment. When a diameter of the squeeze pin cylinder 12 (the head 16) is configured to be 100 mm and the squeeze pin cylinder 12 is moved by 20 mm (a moving amount of the squeeze pin) at two seconds, the flow rate of the operating oil introduced in the hydraulic pressure space 20 on the head 16 side becomes 4.8 l/min.

To the conventional core circuit 50 as well, a valve (not illustrated) to adjust the flow rate of the operating oil is installed. The core needs to be moved fast for cycle-up; therefore, a maximum flow rate is designed to be around 120 l/min. Even if the degree of opening of the valve is attempted to adjust such that the flow rate becomes 4.8 l/min, a slight change in degree of opening largely changes the flow rate; therefore, the adjustment is difficult. Furthermore, the above-described valve does not have a configuration for performing the pressure compensation and the temperature compensation; therefore, the adjustment is extremely difficult.

Meanwhile, as shown in FIG. 3, the flow rate adjusting unit 24 of this embodiment can design the maximum flow rate to 30 l/min. Accordingly, even if the degree of opening is configured so as to yield the flow rate of 4.8 l/min, a gradient of a curved line indicating the flow rate is gentle. Thus, applying the hydraulic pressure to the squeeze pin cylinder 12 via the flow rate adjusting unit 24 of this embodiment slowly enters the squeeze pin to the molten metal according to the shrinkage cavity in the molten metal, thereby ensuring effectively restraining the shrinkage cavity. Further, the flow rate adjusting unit 24 can perform the pressure compensation and the temperature compensation, thereby ensuring stably operating the squeeze pin regardless of the change in pressure from the molten metal and the temperature change in operating oil.

Figure 4:
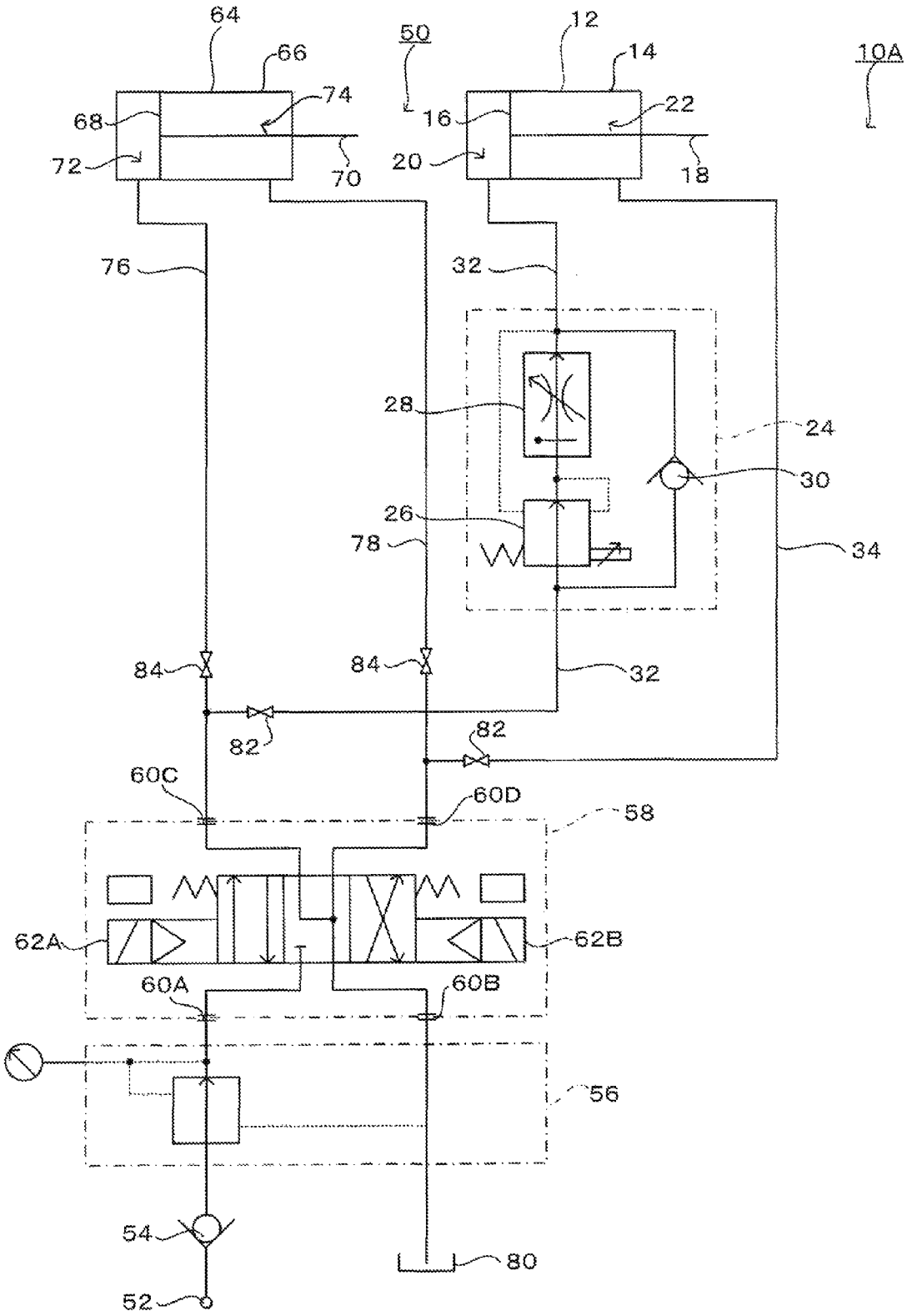
FIG. 4 is a circuit diagram of a squeeze pin circuit of a second embodiment.

FIG. 4 illustrates a squeeze pin circuit of a second embodiment. A squeeze pin circuit 10A of the second embodiment is identical to the squeeze pin circuit of the first embodiment in that the squeeze pin cylinder 12 and the flow rate adjusting unit 24 are installed to the core circuit 50. However, the squeeze pin circuit 10A differs in that hydraulic pressure paths 76 and 78 containing the core cylinder 64 are installed parallel to the squeeze pin circuit 10A.

Not only this embodiment but also other embodiments do not use the core cylinder 64 and the squeeze pin cylinder 12 coupled to the identical direction switching valve 58 simultaneously. Therefore, opening/closing valves 82 and 84 are disposed at the hydraulic pressure paths 32 and 34 and at the hydraulic pressure paths 76 and 78, respectively. To use the squeeze pin cylinder 12, it is only necessary to open the opening/closing valves 82 at the hydraulic pressure paths 32 and 34 and close the opening/closing valves 84 at the hydraulic pressure paths 76 and 78. To use the core cylinder 64, it is only necessary to open the opening/closing valves 84 at the hydraulic pressure paths 76 and 78 and close the opening/closing valves 82 at the hydraulic pressure paths 32 and 34. The configuration can omit replacement work to the direction switching valve 58 between the core cylinder 64 and the squeeze pin cylinder 12, ensuring reduction in work load.

Figure 5:
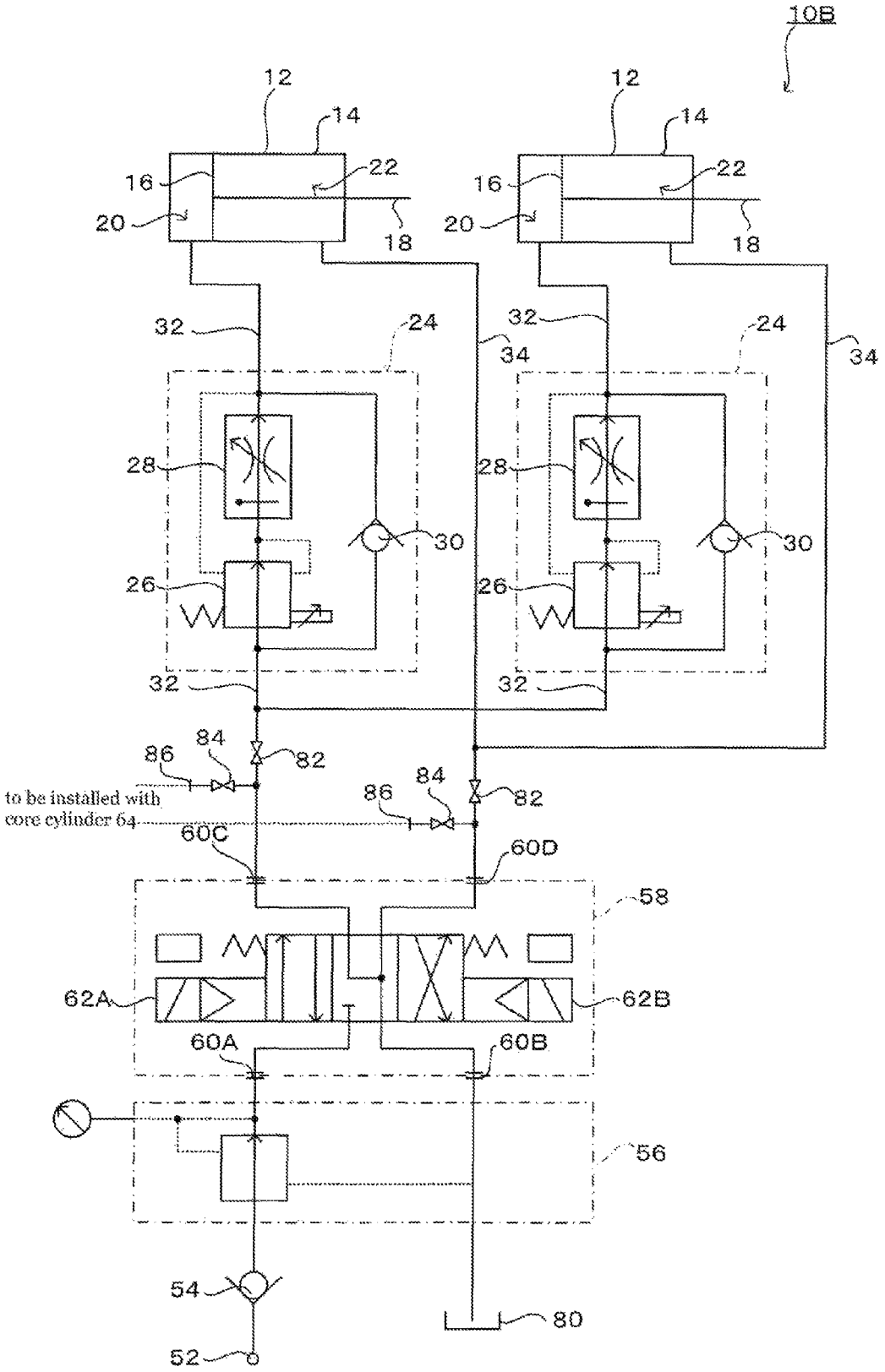
FIG. 5 is a circuit diagram of squeeze pin circuits of a third embodiment.

FIG. 5 illustrates squeeze pin circuits of a third embodiment. A plurality of squeeze pin circuits 10B of the third embodiment are coupled parallel to the direction switching valve 58. This embodiment also includes a port 86 to install the core cylinder 64. Similar to the second embodiment, the core cylinder 64 and the squeeze pin cylinder 12 can be used separately. Conventionally, the use of a plurality of cylinders installed to one direction switching valve causes a phenomenon where an operation of a cylinder with large load resistance slows and after a cylinder with small load resistance operates, the cylinder with large load resistance operates. However, since the flow rate adjusting unit 24 maintains the differential pressure between the hydraulic pressure on the hydraulic pressure supply source 52 side and the hydraulic pressure on the squeeze pin cylinder 12 side, as illustrated in FIG. 5, even if the plurality of squeeze pin cylinders 12 are coupled parallel, the respective flow rate adjusting units 24 can individually maintain the differential pressures and simultaneously move the squeeze pins.

Figure 6:
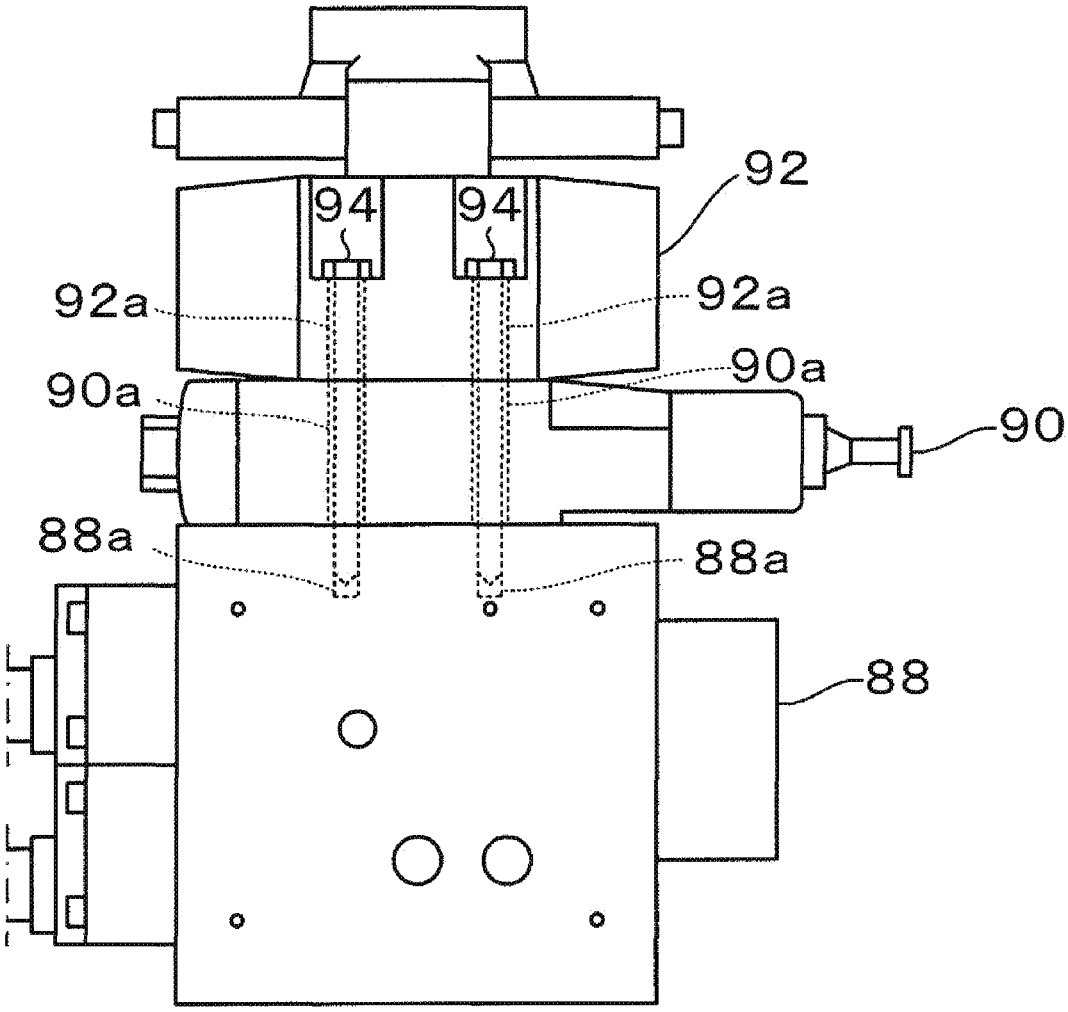
FIG. 6 is a schematic diagram of a hydraulic unit that forms the core circuit.
Figure 7:
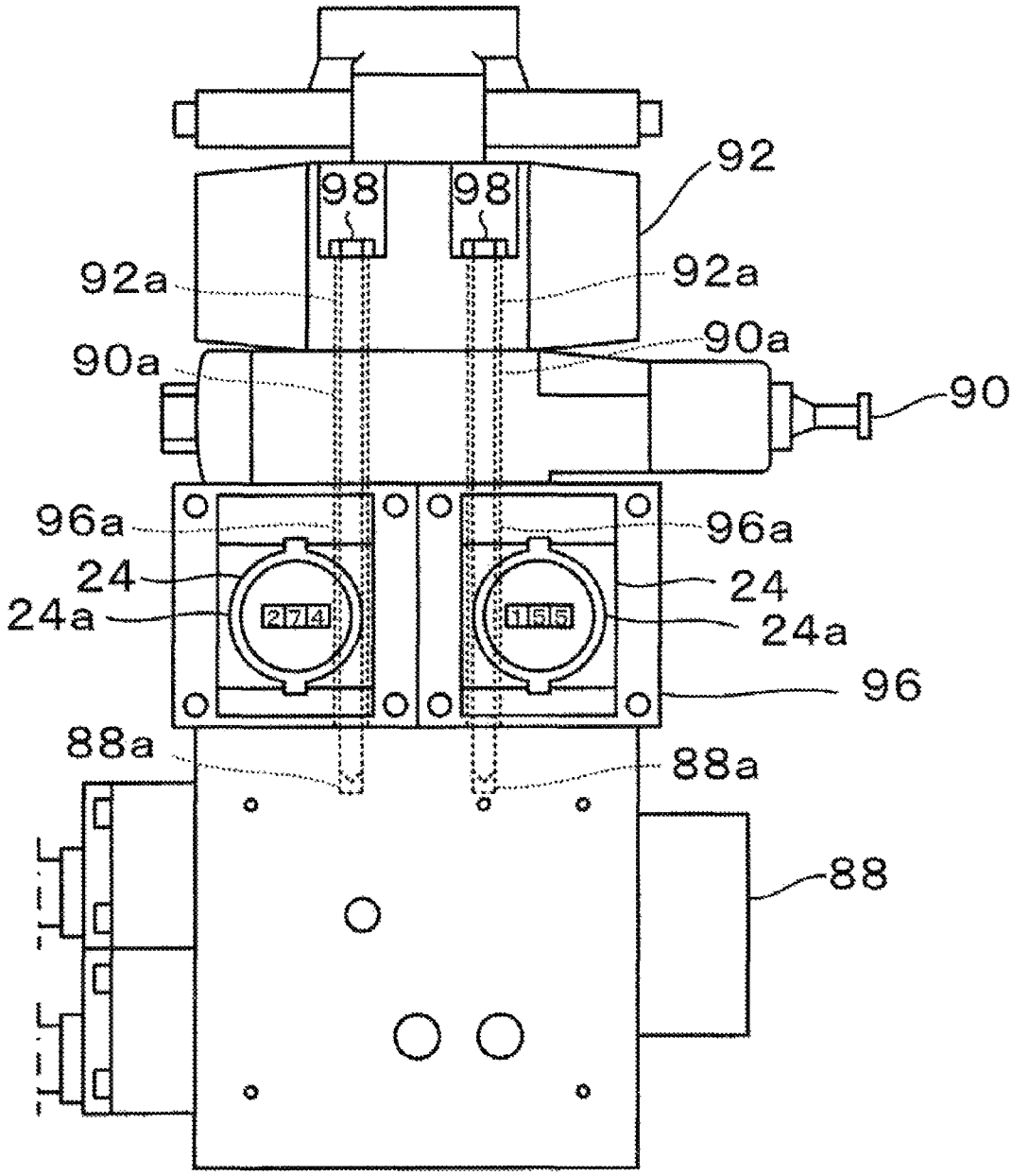
FIG. 7 is a schematic diagram in the case where a sandwich sub that forms the squeeze pin circuit is sandwiched between the hydraulic units.

FIG. 6 is a schematic diagram of a hydraulic unit that forms the core circuit. FIG. 7 is a schematic diagram in the case where a sandwich sub forming the squeeze pin circuit is sandwiched between the hydraulic units. As illustrated in FIG. 6, the core circuit 50 (excluding the core cylinder 64) has a three-stage structure, a manifold 88 (a hydraulic unit), a pressure adjusting unit 90 (a hydraulic unit), and a direction switching unit 92 (a hydraulic unit) in the order from the lower. In the manifold 88, most part of the hydraulic pressure paths 76 and 78 constituting the core circuit 50 is integrated into a block. In the pressure adjusting unit 90, the pressure adjusting valve 56 and members attached to the pressure adjusting valve 56 are integrated into a block. In the direction switching unit 92, the direction switching valve 58 and the solenoids 62A and 62B are integrated into a block.

The manifold 88 includes internal screws 88*a* screwed with through bolts 94. At the pressure adjusting unit 90 and the direction switching unit 92, insertion holes 90*a* and 92*a* through which the through bolts 94 are inserted are formed. The manifold 88, the pressure adjusting unit 90, and the direction switching unit 92 are stacked such that the internal screws 88*a*, the insertion holes 90*a*, and the insertion holes 92*a* are communicated. Introducing the through bolts 94 from the insertion holes 92*a* and screwing the through bolts 94 into the internal screws 88*a* secures the all hydraulic units so as to be integrated with the manifold 88, the pressure adjusting unit 90, and the direction switching unit 92 fastened together. FIG. 6 (FIG. 7) omits hydraulic pipes that couple the respective units and similar members.

The squeeze pin circuit 10 (excluding the squeeze pin cylinder 12) of this embodiment and a similar member can also be formed into a block as a sandwich sub 96 (a hydraulic unit). As illustrated in FIG. 7, the sandwich sub 96 is formed such that the hydraulic pressure paths 32 and 34, which constitute the two flow rate adjusting units 24, the squeeze pin circuit 10, and a similar member, are formed into one block-shaped lump. Assume that the two flow rate adjusting units 24 are coupled parallel to the direction switching valve 58 like the third embodiment.

As illustrated in FIG. 7, the sandwich sub 96 is disposed between the manifold 88 and the pressure adjusting unit 90. The sandwich sub 96 is configured to include insertion holes 96*a* communicated with the insertion holes 90*a* and similar members. Introducing through bolts 98, which are designed longer than the through bolts 94, from the insertion holes 92*a* and screwing the through bolts 98 into the internal screws 88*a* ensures securing the all hydraulic units so as to be integrated with the manifold 88, the sandwich sub 96, the pressure adjusting unit 90, and the direction switching unit 92 fastened together.

Thus sandwiching the sandwich sub 96 in the existing facility (the hydraulic units constituting the core circuit 50) ensures easily configuring the squeeze pin circuit 10 and a similar member with stable flow rate. A rotation of an attached handlebar 24*a* (causing the flow rate adjusting valve 28 to operate) adjusts the degree of opening of the flow rate adjusting unit 24. As illustrated in FIG. 7, displaying the degree of opening in digital (the horizontal axis of the graph in FIG. 3) is preferable. This enhances reproducibility of the degree of opening in the flow rate adjusting unit 24, thereby ensuring improvising work efficiency. As described above, in the core circuit 50 before the squeeze pin circuit 10 and a similar member are installed, although the operating oil is used at a flow rate close to 120 l/min, since the flow rate adjusting unit 24 uses the operating oil at the flow rate of close to 4.8 l/min, a pressure loss is large. Therefore, it is also possible to set the degrees of opening of the two flow rate adjusting units 24 to values different from one another.

The embodiment describes assuming the squeeze pin used for high-pressure die casting; however, the embodiment is also applicable to a squeeze pin used for other castings using a mold such as a gravitation casting and a low-pressure casting.

Figure 8:
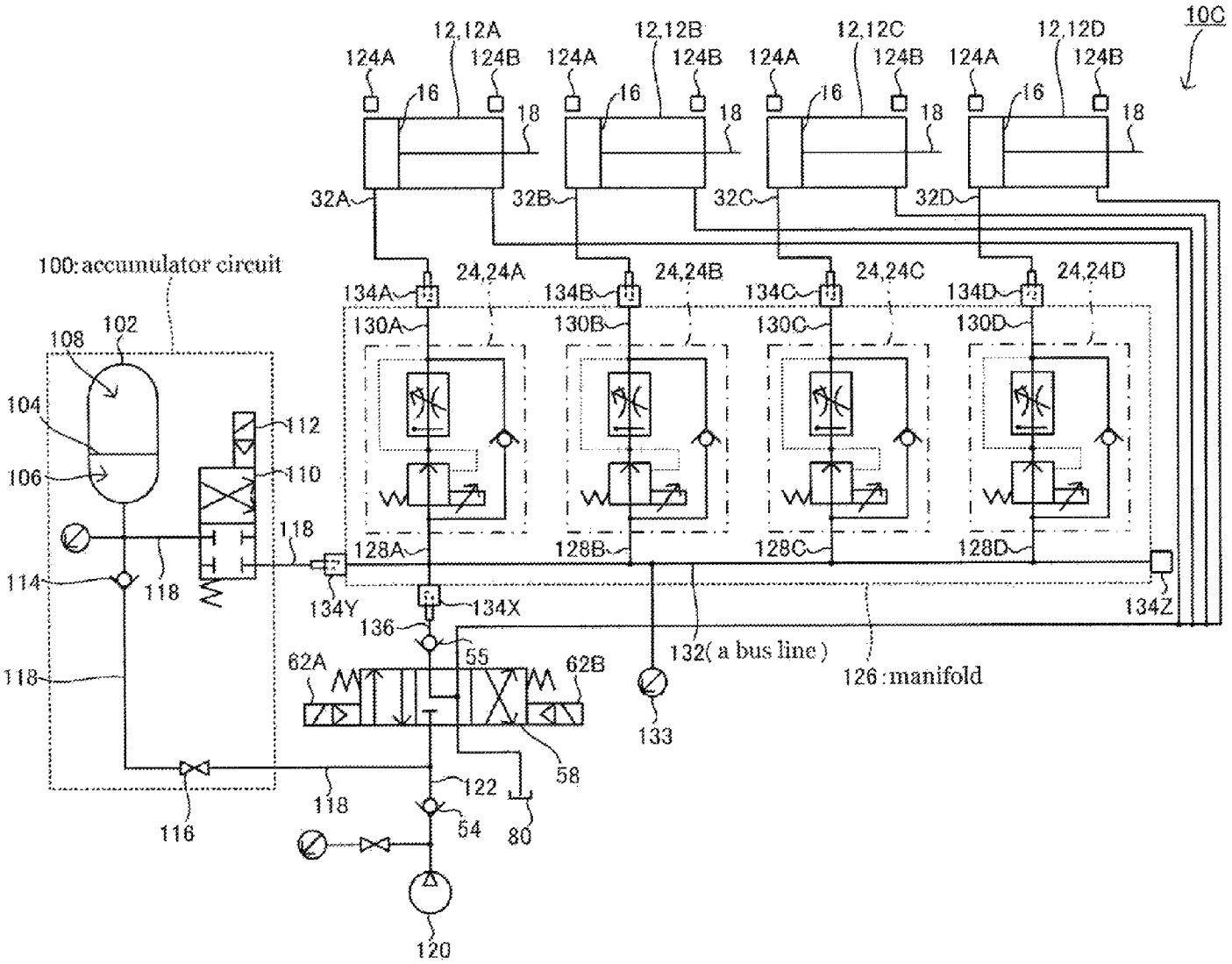
FIG. 8 is a circuit diagram of a squeeze pin circuit (a hydraulic unit) of a fourth embodiment.

FIG. 8 is a circuit diagram of a squeeze pin circuit (a hydraulic unit) of a fourth embodiment. A squeeze pin circuit 10C (a hydraulic unit) of the fourth embodiment is similar to the squeeze pin circuit 10B of the third embodiment in that the plurality of (four in this embodiment) hydraulic pressure circuits, which are formed of flow rate adjusting units 24 (24A to 24D) and squeeze pin cylinders 12 (12A to 12D), are coupled in parallel to the one direction switching valve 58. However, the squeeze pin circuit 10C differs from the squeeze pin circuit 10B in that an accumulator circuit 100 is additionally installed.

The accumulator circuit 100 is configured of an accumulator 102, a direction switching valve 110, a check valve 114, an opening/closing valve 116, and a similar member. A hydraulic pressure path 118 passing through the accumulator circuit 100 branches from a hydraulic pressure path 122, which couples a hydraulic pressure source 120 to the direction switching valve 58, continues to the opening/closing valve 116, the check valve 114, and the direction switching valve 110, and then is coupled to primary sides of the flow rate adjusting units 24. The accumulator 102 is installed to a position between the check valve 114 and the direction switching valve 110 at the hydraulic pressure path 118.

The accumulator 102 is a tank inside of which is partitioned by a partition wall 104. An internal space 106, which is on the hydraulic pressure path 118 side in the accumulator 102, accumulates the operating oil. An internal space 108, which is on the opposite side from the internal space 106, is filled with gas. In the case where the hydraulic pressure at the hydraulic pressure path 118 is greater than the gas pressure inside the accumulator 102, the operating oil inside the hydraulic pressure path 118 is pressed into the accumulator 102 to apply the hydraulic pressure to the partition wall 104, thus deforming the partition wall 104 to compress the gas. In the opposite case, the gas pressure applied to the partition wall 104 presses the operating oil inside the accumulator 102 to apply the hydraulic pressure originated from the gas pressure to the hydraulic pressure path 118.

The direction switching valve 110 is an opening/closing valve that operates in conjunction with the direction switching valve 58. Although the direction switching valve 110 usually cuts off the hydraulic pressure path 118, the operation of the solenoid 112 of the direction switching valve 110 in conjunction with the operation of the solenoid 62A of the direction switching valve 58 opens the hydraulic pressure path 118. The check valve 114 prevents the operating oil pressed from the accumulator 102 from flowing backward to the hydraulic pressure source 120 side.

In the configuration, before the squeeze pin operates, the direction switching valve 58 cuts off the hydraulic pressure of the hydraulic pressure path 122 to the flow rate adjusting unit 24 sides (the hydraulic pressure path 136) and the direction switching valve 110 cuts off the hydraulic pressure path 118. As long as the opening/closing valve 116 is open, the accumulator 102 accumulates the hydraulic pressure (the gas pressure) from the hydraulic pressure source 120. Operating the solenoid 62A and the solenoid 112 causes the direction switching valve 58 to open the hydraulic pressure of the hydraulic pressure path 122 to the flow rate adjusting unit 24 side (the hydraulic pressure path 136) and causes direction switching valve 110 to open the hydraulic pressure path 118. Accordingly, to the primary sides (the hydraulic pressure paths 128A to 128D) of the flow rate adjusting units 24, the hydraulic pressure combining the hydraulic pressure from the hydraulic pressure source 120 with the hydraulic pressure from the accumulator 102 is applied.

Like this embodiment, in the case where the plurality of flow rate adjusting units 24 (24A to 24D) are coupled parallel to the one direction switching valve 58, namely, the one hydraulic pressure source 120, the hydraulic pressure from the hydraulic pressure source 120 disperses and the hydraulic pressure applied to the primary sides of the individual flow rate adjusting units 24 reduces, thus reducing the operating speed of the squeeze pins. However, as illustrated in FIG. 8, coupling the accumulator circuit 100 to the primary sides of the flow rate adjusting units 24 can supply a sufficient hydraulic pressure to the flow rate adjusting units 24, thereby ensuring reliably operating the squeeze pins.

The accumulator circuit 100 can also accumulate the hydraulic pressure by another hydraulic pressure source other than the hydraulic pressure source 120. In this case, when the hydraulic pressure inside the accumulator circuit 100 is greater than the hydraulic pressure from the hydraulic pressure source 120, the hydraulic pressure from the accumulator circuit 100 possibly flows backward through a hydraulic pressure path 136. In this case, a check valve 55 is installed to the hydraulic pressure path 136 to ensure preventing the adverse current of the hydraulic pressure.

Limit switches are installed to the squeeze pin cylinders 12 (12A to 12D) to operate the squeeze pins. Limit switches 124A and 124B detect a magnetic force of a magnet (not illustrated), which is installed at the head 16 of the rod 18 directly coupled to the squeeze pin, when the magnet comes to a position opposed to the limit switches 124A and 124B and output detection signals. The limit switch 124A is installed at a position opposed to the initial position of the head 16 before the squeeze pin is fed. The limit switch 124B is installed at a position opposed to a feeding position of the head 16 after the squeeze pin is fed.

Figure 9:
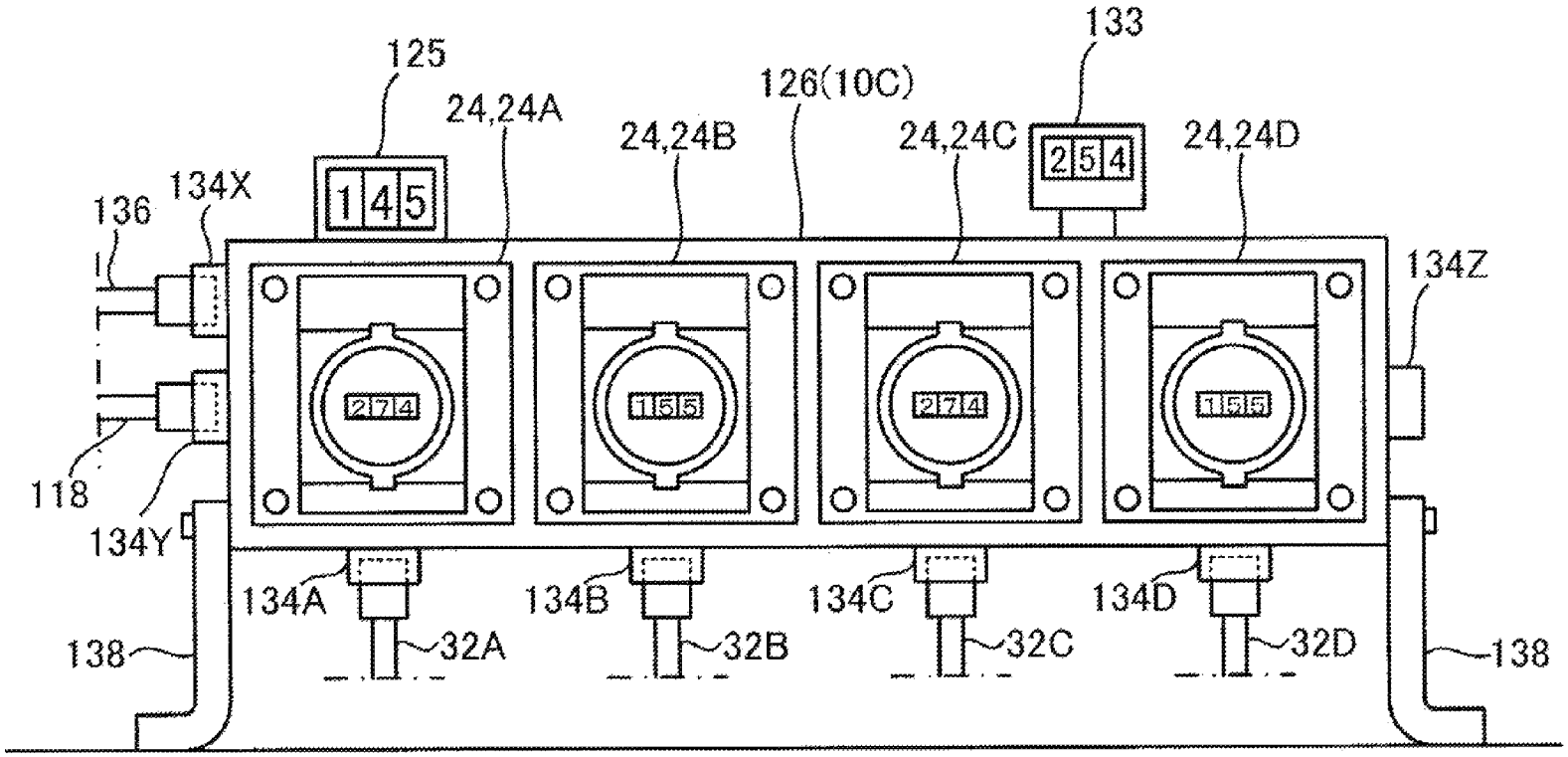
FIG. 9 is a schematic diagram of a manifold constituting the squeeze pin circuit of the fourth embodiment.

In the squeeze pin circuit 10C, before the squeeze pin operates, the limit switch 124A outputs the detection signal and the limit switch 124B does not output the detection signal. Operating the squeeze pin (supplying the hydraulic pressure from the hydraulic pressure source 120 and the accumulator 102 to the flow rate adjusting units 24) stops the output of the detection signal by the limit switch 124A. After a while, the detection signal is output from the limit switch 124B. A distance between the detecting position of the limit switch 124A and the detecting position of the limit switch 124B can be an already-known distance (approximately identical to a feeding amount of the squeeze pin). This ensures calculating feeding times and feeding speeds of the respective squeeze pins using a difference between the time when the output of the detection signal from the limit switch 124A stops and the time when the output signal is output from the limit switch 124B. Adjusting the flow rate by the flow rate adjusting unit 24 ensures adjusting the feeding speed of the squeeze pin. This allows adjusting the feeding time and the feeding speed appropriate for each of the squeeze pins installed at different positions from one another in the mold for manufacturing die-cast products while monitoring, thereby ensuring further accurate quality management of the die-cast products. The detection signals from the limit switches 124A and 124B are output to time measurement means 125, which will be described later (FIG. 9). The limit switches 124A and 124B need not to be installed to all the squeeze pin cylinders 12.

Although FIG. 8 illustrates the squeeze pin circuit 10C that includes the accumulator circuit 100, FIG. 8 also illustrates a hydraulic unit that includes the squeeze pin circuit 10C. The hydraulic unit includes a manifold 126 (the block), and the four flow rate adjusting units 24A to 24D are installed to the manifold 126. The manifold 126 includes a part of the hydraulic pressure paths inside the block like the sandwich sub 96 and the manifold 88 illustrated in FIG. 7.

The manifold 126 includes hydraulic pressure paths 128A to 128D, hydraulic pressure paths 130A to 130D, and a hydraulic pressure path 132 (a bus line). The hydraulic pressure paths 128A to 128D are coupled to the primary sides of the flow rate adjusting units 24A to 24D (an upstream side of the hydraulic pressure and a side where the hydraulic pressure from the hydraulic pressure source 120 or the accumulator circuit 100 is received). The hydraulic pressure paths 130A to 130D are coupled to secondary sides of the flow rate adjusting units 24A to 24D (a downstream side of the hydraulic pressure and a side where the hydraulic pressure is supplied to the squeeze pin cylinder 12). The hydraulic pressure path 132 penetrates the manifold 126. Among the hydraulic pressure paths 128A to 128D, the hydraulic pressure path 128A reaches a surface of the manifold 126. The hydraulic pressure path 132 intersects with (is coupled to) the hydraulic pressure path 128A and is coupled to hydraulic pressure paths 128B to 128D.

Ports 134A to 134D are disposed at positions on the hydraulic pressure paths 130A to 130D that become openings on the surface of the manifold 126. A port 134X is disposed at a position on the hydraulic pressure path 128A that becomes an opening on the surface of the manifold 126. Ports 134Y and 134Z are disposed at positions on the hydraulic pressure path 132 that become openings on the surface of the manifold 126 (both ends of the hydraulic pressure path 132). The ports 134A to 134D and 134X to 134Z can also be established in a coupler structure that opens the flow passage for operating oil only when the hydraulic pressure path (the pipe for hydraulic pressure) is coupled.

In the manifold 126, the ports 134A to 134D are coupled to hydraulic pressure paths 32A to 32D, which are coupled to the squeeze pin cylinders 12A to 12D on the head 16 sides. The port 134X is coupled to the hydraulic pressure path 136, which is coupled to the direction switching valve 58. The port 134Y is coupled to the hydraulic pressure path 118 to which the direction switching valve 110 is coupled. The port 134Z is closed without coupled to another hydraulic pressure path. To the manifold 126, pressure measurement means 133 (see FIG. 9) that measures a pressure inside the hydraulic pressure path 132 (the bus line) is installed.

FIG. 9 illustrates a schematic diagram of the manifold constituting the squeeze pin circuit of the fourth embodiment. As illustrated in FIG. 9, the four flow rate adjusting units 24A to 24D are installed to the side surfaces of the manifold 126 in the longitudinal direction. The port 134X and the port 134Y are installed to one side surface of the manifold 126 in the short side direction, and the port 134Z is installed to the other side surface. Legs 138 are installed to the manifold 126 to support the manifold 126 at a predetermined height by the legs 138. The ports 134A to 134D are installed to a lower surface (may be a top surface) of the manifold 126.

As illustrated in FIG. 8, the hydraulic pressure introduced from the port 134X is supplied to the primary sides of the flow rate adjusting units 24A to 24D via the hydraulic pressure path 132 and the hydraulic pressure paths 128A to 128D. Similarly, the hydraulic pressure introduced from the port 134Y is supplied to the primary sides of the flow rate adjusting units 24A to 24D via the hydraulic pressure path 132 and the hydraulic pressure paths 24A to 24D. That is, the hydraulic pressure originated from the port 134X and the hydraulic pressure originated from the port 134Y are simultaneously supplied to the respective flow rate adjusting units 24A to 24D. This ensures solving an insufficient hydraulic pressure to the flow rate adjusting units 24A to 24D.

In the manifold 126, the hydraulic pressure path 132 couples the hydraulic pressure paths 128A to 128D in parallel and serves as the bus line penetrating the manifold 126. Furthermore, the hydraulic pressure path 132 has the port 134Y and the port 134Z at both ends so as to be couplable to another hydraulic pressure path outside the manifold 126. Accordingly, with the plurality of manifolds 126, only coupling the bus lines in series (see FIG. 10) can operate the squeeze pin circuits 10C installed to the respective manifolds 126. This ensures easy replacement work.

As illustrated in FIG. 9, the time measurement means 125 is installable to the manifold 126. The time measurement means 125 measures and displays an operating time of the squeeze pin (the rod 18) based on the detection signals output from the limit switches 124A and 124B. That is, the time measurement means 125 starts measuring the time from when the detection signal from the limit switch 124A turns off (the rod 18 starts moving to the squeeze pin side) until the detection signal from the limit switch 124B turns on for measurement and display. In FIG. 9, only the time measurement means 125 coupled to the limit switches 124A and 124B installed to the squeeze pin cylinder 12A (FIG. 8) is installed. However, the time measurement means coupled to the respective limit switches 124A and 124B installed to the squeeze pin cylinders 12B to 12D (FIG. 8) are also installable to the manifold 126.

The pressure measurement means 133 is installed to the manifold 126. The pressure measurement means 133 measures the hydraulic pressure at the hydraulic pressure path 132 (the bus line). As described above, the flow rate adjusting valve 28 operates so as to compensate the pressure difference between the primary side (the hydraulic pressure source 120 side) of the flow rate adjusting valve 28 and the secondary side (the squeeze pin cylinder 12 side) of the flow rate adjusting valve 28. However, if the hydraulic pressure inside the hydraulic pressure path 132 becomes a constant value (for example, 1 Mpa) or less during the operation of the squeeze pin (the rod 18), the compensation of the pressure difference is difficult. This concentrates the hydraulic pressure to the flow rate adjusting valve 28 whose flow rate is set large, failing to reach the hydraulic pressure to the other flow rate adjusting valves 28. Thus, when the pressure reduction on the primary side can be confirmed by the pressure measurement means 133, the accumulator circuit 100 is installed to the manifold 126 as described later to ensure preventing the pressure reduction. After the operation of the squeeze pin, the pressure inside the hydraulic pressure path 132 (the bus line) increases up to a pressure value almost equivalent to the hydraulic pressure of the hydraulic pressure source 120 or the accumulator circuit 100.

Figure 10:
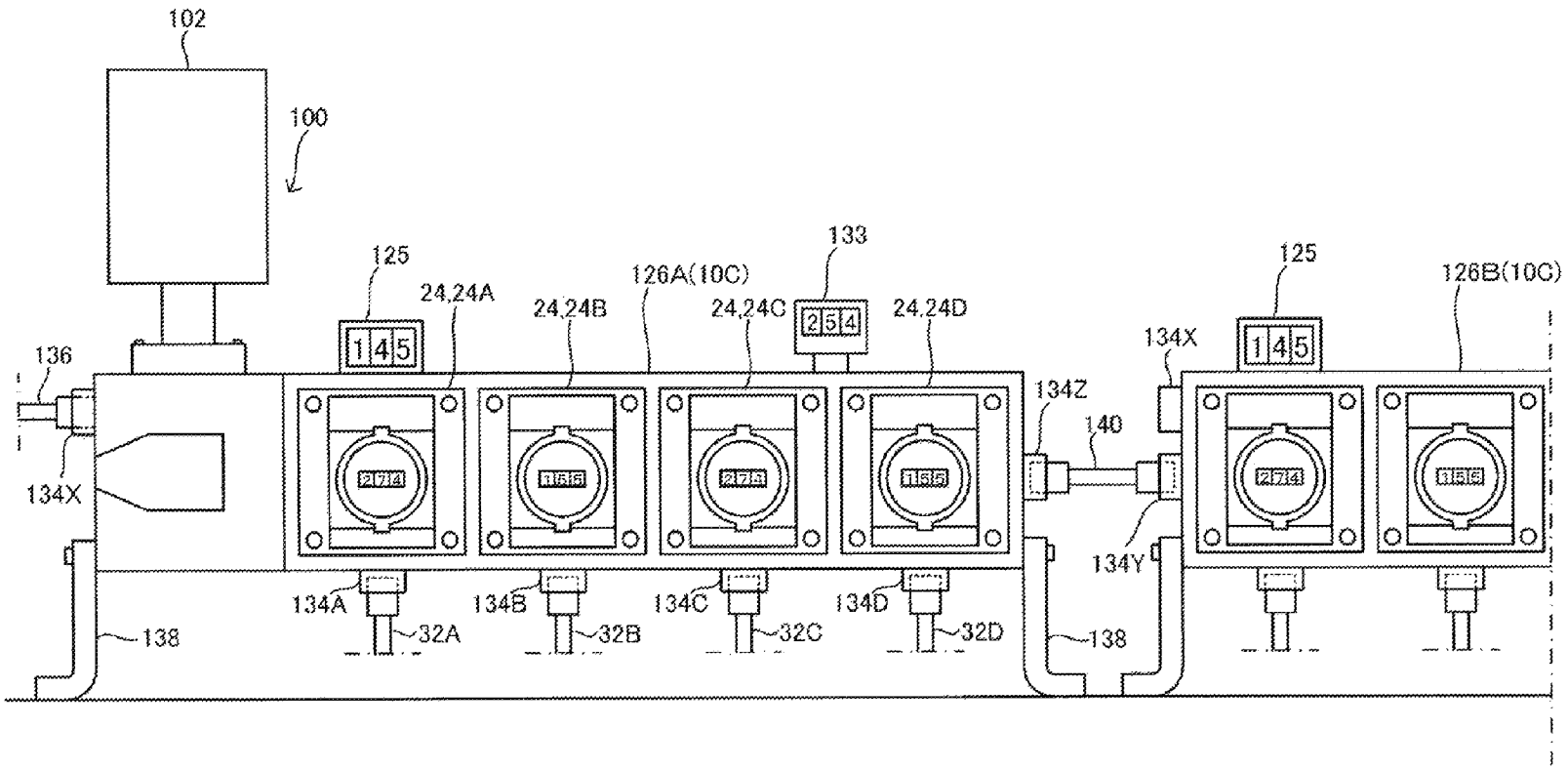
FIG. 10 is a schematic diagram of the manifolds (additionally installed) constituting the squeeze pin circuits of the fourth embodiment.

FIG. 10 is a schematic diagram of the manifolds (additionally installed) constituting the squeeze pin circuits of the fourth embodiment. As illustrated in FIG. 10, the accumulator circuit 100 is installable to a manifold 126A so as to be integrated. In this case, the hydraulic pressure path 118 has a terminating end inside the accumulator circuit 100. A hydraulic pressure path 128A is passed through the formation part of the accumulator circuit 100 in the manifold 126A, and the port 134X can be disposed at the outside.

As illustrated in FIG. 10, the port 134Z of the manifold 126A may be coupled to an additionally prepared port 134Y of a manifold 126B (may be the port 134X and the port 134Z) with a hydraulic pressure path 140. The port 134X and the port 134Z (not illustrated) of the manifold 126B are closed without being coupled to other hydraulic pressure paths. This makes the eight squeeze pin cylinders 12 operable. The sandwich sub 96, which is illustrated in FIG. 7, may include a bus line similar to one as described above, and this bus line may be coupled to bus lines of the manifolds 126 (126A and 126B).

Figure 11:
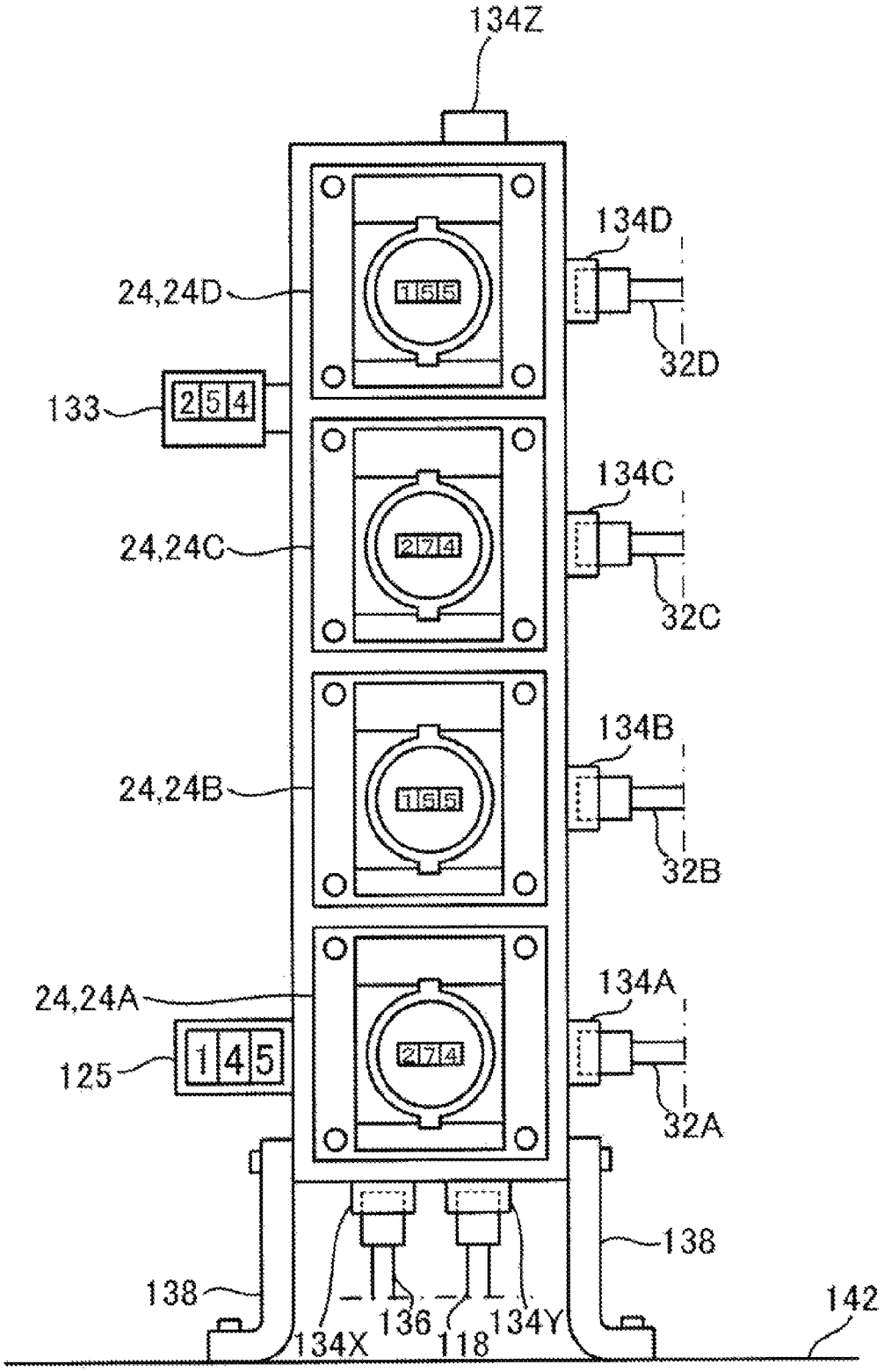
FIG. 11 is a schematic diagram of a manifold constituting a squeeze pin circuit of a modification of the fourth embodiment.

FIG. 11 illustrates a schematic diagram of a manifold constituting a squeeze pin circuit of a modification of the fourth embodiment. As illustrated in FIG. 11, the manifold 126 is vertically elongated. The manifold 126 is installable to a mold 142 to which a squeeze pin, which is an application target for the manifold 126, is installed. The flow rate adjusting units 24 are installed to the manifold 126 to be arranged in a vertically-elongated direction. In this case, as illustrated in FIG. 11, the flow rate adjusting units 24, time measurement means 125, and pressure measurement means 133 are installable to the manifold 126 such that a display indicative of the degree of opening of the flow rate adjusting unit 24, a display indicative of a time of the time measurement means 125, and a display indicative of a pressure of the pressure measurement means 133 each face the horizontal direction. The two legs 138, which are illustrated in FIG. 9 and FIG. 10, of the manifold 126 may be installed to one side (in FIG. 10, for example, the accumulator circuit 100) of the manifold 126 in the longitudinal direction) to configure the manifold 126 to be the vertical type.

The mold 142 to which the manifold 126 is installed may be a fixed mold or a movable mold. With the mold 142, the identical die casting forming is repeated; therefore, the squeeze pin installed to the mold 142 also repeats the identical operation at the die casting forming. Accordingly, once setting the degrees of opening by the flow rate adjusting units 24A to 24D, the subsequent change is principally unnecessary. Accordingly, installing the manifolds 126 individually to various kinds of molds allows the efficient die casting forming omitting the adjustment work of the operation of squeeze pins when the type of the mold is changed. Configuring the vertical manifold 126 ensures establishing the space-saving hydraulic units (the squeeze pin circuits 10C). Obviously, the manifold 126 illustrated in FIG. 9 and FIG. 10 is also installable to the mold 142 without changing the form.

DESCRIPTION OF REFERENCE SIGNS

10 . . . squeeze pin circuit
12 . . . squeeze pin cylinder
14 . . . cylinder body
16 . . . head
18 . . . rod
20 . . . hydraulic pressure space
22 . . . hydraulic pressure space
24 . . . flow rate adjusting unit
24*a* . . . handlebar
26 . . . pressure compensation valve
28 . . . flow rate adjusting valve
30 . . . check valve

32 . . . hydraulic pressure path
34 . . . hydraulic pressure path
50 . . . core circuit
52 . . . hydraulic pressure supply source
54 . . . check valve
56 . . . pressure adjusting valve
58 . . . direction switching valve
60A to 60D . . . port
62A, 62B . . . solenoid
64 . . . core cylinder
66 . . . cylinder body
68 . . . head
70 . . . rod
72 . . . hydraulic pressure space
74 . . . hydraulic pressure space
76 . . . hydraulic pressure path
78 . . . hydraulic pressure path
80 . . . tank
82 . . . opening/closing valve
84 . . . opening/closing valve
86 . . . port
88 . . . manifold
88*a* . . . internal screw
90 . . . pressure adjusting unit
90*a* . . . insertion hole
92 . . . direction switching unit
92*a* . . . insertion hole
94 . . . through bolt
96 . . . sandwich sub
96*a* . . . insertion hole
98 . . . through bolt
100 . . . accumulator circuit
102 . . . accumulator
104 . . . division wall
106 . . . internal space
108 . . . internal space
110 . . . direction switching valve
112 . . . solenoid
114 . . . check valve
116 . . . opening/closing valve
118 . . . hydraulic pressure path
120 . . . hydraulic pressure source
122 . . . hydraulic pressure path
124A, 124B . . . limit switch
126 . . . manifold
128A to 128D . . . hydraulic pressure circuit
130A to 130D . . . hydraulic pressure circuit
132 . . . hydraulic pressure path
134A to 134D, 134X to 134Z . . . port
136 . . . hydraulic pressure path
138 . . . leg
140 . . . hydraulic pressure path

The invention claimed is:

1. A squeeze pin circuit for die casting installed to a direction switching valve, the direction switching valve being configured to switch a direction of hydraulic pressure to a core cylinder, the squeeze pin circuit being configured to drive a squeeze pin, the squeeze pin being configured to partially pressurize molten metal filled in a cavity, the squeeze pin circuit comprising:

a squeeze pin cylinder and the core cylinder coupled to the direction switching valve to drive the squeeze pin and a core; and a flow rate adjusting unit installed on a hydraulic pressure path, the hydraulic pressure path coupling the direction switching valve to a head side of the squeeze pin cylinder, the flow rate adjusting unit being configured to ensure pressure compensation and temperature compensation.

2. The squeeze pin circuit for die casting according to claim 1, wherein the flow rate adjusting unit includes a check valve configured to allow a hydraulic pressure in a direction heading for the direction switching valve in the hydraulic pressure path.

3. The squeeze pin circuit for die casting according to claim 1, wherein the flow rate adjusting unit is configured to ensure displaying a degree of opening in the hydraulic pressure path in digital.

4. The squeeze pin circuit for die casting according to claim 1, wherein the hydraulic pressure path is coupled parallel to a hydraulic pressure path at one side of the core cylinder, a hydraulic pressure path coupling the direction switching valve to a rod side of the squeeze pin cylinder being coupled parallel to a hydraulic pressure path at another side of the core cylinder.

5. The squeeze pin circuit for die casting according to claim 1, wherein a plurality of squeeze pin cylinders and a plurality of flow rate adjusting units are coupled parallel to the direction switching valve.

6. The squeeze pin circuit for die casting according to claim 5, further comprising an accumulator circuit configured to accumulate a hydraulic pressure from a hydraulic pressure source that supplies the direction switching valve with a hydraulic pressure, the accumulator circuit being configured to supply the hydraulic pressure to hydraulic pressure paths on primary sides of the flow rate adjusting units.

7. A hydraulic unit that includes the squeeze pin circuit for die casting according to claim 1, comprising a block to which the flow rate adjusting unit is installed, the block including a hydraulic pressure path at a primary side of the flow rate adjusting unit, wherein the block includes a bus line coupled to the hydraulic pressure path on the primary side, the bus line penetrating the block.

8. The hydraulic unit according to claim 7, further comprising:

a limit switch configured to output a signal indicative of the squeeze pin being at a position before feeding, the limit switch being configured to output a signal indicative of the squeeze pin being at a position after the feeding; and time measurement means installed to the block, the time measurement means being configured to measure an operating time of the squeeze pin based on the signal output from the limit switch.

9. The hydraulic unit according to claim 7, wherein pressure measurement means is installed to the block, the pressure measurement means being configured to measure a hydraulic pressure inside the bus line.

10. The hydraulic unit according to claim 7, wherein the block is installed to a mold to which the squeeze pin is installed, the squeeze pin being driven by the squeeze pin circuit.

11. The hydraulic unit according to claim 10, wherein:

in a case where a plurality of flow rate adjusting units are installed to the block, the block is installed to the mold in a vertically-elongated state, and the flow rate adjusting units are installed to the block to be arranged in the vertically-elongated direction.

* * * * *